United States Patent [19]

Brunnschweiler

[11] Patent Number: 4,574,433

[45] Date of Patent: Mar. 11, 1986

[54] FIBRE METERING ARRANGEMENT

[75] Inventor: David Brunnschweiler, Blackburn, England

[73] Assignee: Haigh Chadwick Limited, West Yorkshire, England

[21] Appl. No.: 591,483

[22] Filed: Mar. 20, 1984

[30] Foreign Application Priority Data

Apr. 19, 1983 [GB] United Kingdom ..... 8310566
Sep. 20, 1983 [GB] United Kingdom ..... 8325095

[51] Int. Cl.[4] ..... D01H 5/38

[52] U.S. Cl. ..... 19/105; 19/240; 19/300

[58] Field of Search ..... 19/105, 300, 240

[56] References Cited

U.S. PATENT DOCUMENTS

| | | | |
|---|---|---|---|
| 3,363,286 | 1/1968 | Scott et al. | 19/66 CC |
| 3,829,751 | 8/1974 | Bottone | 19/240 X |
| 4,199,843 | 4/1980 | Leifeld et al. | 19/240 |
| 4,271,565 | 6/1981 | Grunder | 19/240 |
| 4,387,486 | 6/1983 | Keller et al. | 19/240 X |
| 4,506,413 | 3/1985 | Leifeld | 19/300 X |

FOREIGN PATENT DOCUMENTS

| | | | |
|---|---|---|---|
| 587418 | 11/1959 | Canada | 19/300 |
| 635606 | 1/1962 | Canada | 19/240 |
| 2506061 | 9/1975 | Fed. Rep. of Germany | 19/240 |
| 1141361 | 1/1969 | United Kingdom | 19/300 |
| 1443258 | 7/1976 | United Kingdom | 19/240 |

*Primary Examiner*—Louis K. Rimrodt
*Attorney, Agent, or Firm*—Oblon, Fisher, Spivak, McClelland & Maier

[57] ABSTRACT

A fibre metering arrangement comprises a supply conveyor carrying fibre to a weighplate, and a nip roller arrangement removing the fibre from the weighplate, and being sufficiently spaced from the weighplate so as not to cause the fibre to accumulate over the weighplate. If the gap is such that some fleece might sag, a bridging plate or a take-off conveyor can be inserted. Preferably, there is a draft between the supply conveyor and the take-off conveyor or nip rollers.

27 Claims, 4 Drawing Figures

FIBRE METERING ARRANGEMENT

BACKGROUND TO THE INVENTION

This invention relates to fibre metering arrangements.

Metering arrangements are known in which fibre is fed on to a weighplate and removed by a nip roller arrangement. The rate of feed is adjusted so as to tend to keep the weight on the weighplate constant so as to meter the fibre at a constant rate.

Difficulties are encountered with these arrangements in that the fibre can accumulate over the weighplate and this gives rise to inaccuracies in the metering or even to a breakdown of the system.

The present invention provides a metering arrangement in which the fibre does not tend to accumulate over the weighplate.

BRIEF DESCRIPTION OF THE INVENTION

Metering arrangements for fibre according to the present invention generally comprise a supply conveyor carrying fibre to a weighplate, and a roller arrangement removing the fibre from the weighplate, and being sufficiently spaced from the weighplate so as not to cause the fibre to accumulate over the weighplate.

The said roller arrangement may comprise nip rollers or a single roller with a cooperating dish.

The fibre may be supplied to the weighplate in a fleece up to, say, some ten centimeters or more thick. It has now been found that the spacing of the roller arrangement from the edge of the weighplate needs to be at least the thickness of the fleece.

If this means that the fleece needs further support between the edge of the weighplate and the roller arrangement, a fixed plate may be provided to bridge such gap. It has been found that such a plate can also interfere with accurate weighing by the weighplate, but we have now found that such interference is also substantially reduced or eliminated by providing a draft between the roller arrangement and the supply conveyor—the roller arrangement may, typically, run some 10% faster than the supply conveyor to provide an adequate draft.

If the roller arrangement is placed even further away from the edge of the weighplate, a take-off conveyor may be interposed instead of a plate.

The take-off conveyor may be arranged to run faster than the supply conveyor, say by about 10%. The roller arrangement may also be arranged to run faster than the take-off conveyor—also by, say, about 10%.

The take-off conveyor may be driven independently of the supply conveyor, and the roller arrangement may be driven independently of the take-off conveyor.

The arrangement may comprise control means operative to effect a constant weight output, and such control means may control the speed of the supply conveyor in response to signals from the weighplate so as to tend to maintain the indicated weight constant, while the speed of the roller arrangement or take-off conveyor is held steady.

The weighplate and bridging plate, where provided, may have a low-friction surface, such as poly-tetrafluoroethylene, and in any event the take-off conveyor where provided and if desired also the supply conveyor may have a surface friction substantially higher than that of the weighplate surface.

The arrangement may include means for determining the moisture content of fibres being metered. Such moisture content means may comprise capacitance means, which may comprise the weighplate as one electrode. The moisture content means may be adapted to affect the rate of metering so as to compensate for the moisture content of the fibre.

BRIEF DESCRIPTION OF THE DRAWINGS

Embodiments of fibre metering arrangements according to the invention will now be described with reference to the accompanying drawings, in which.

DETAILED DESCRIPTION OF THE PREFERRED EMBODIMENTS

Figure 1:
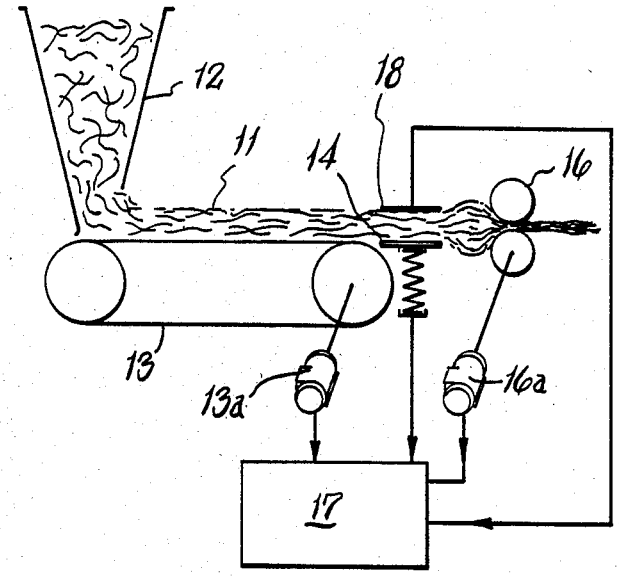
FIG. 1 is a diagrammatic illustration of a first embodiment.
Figure 2:
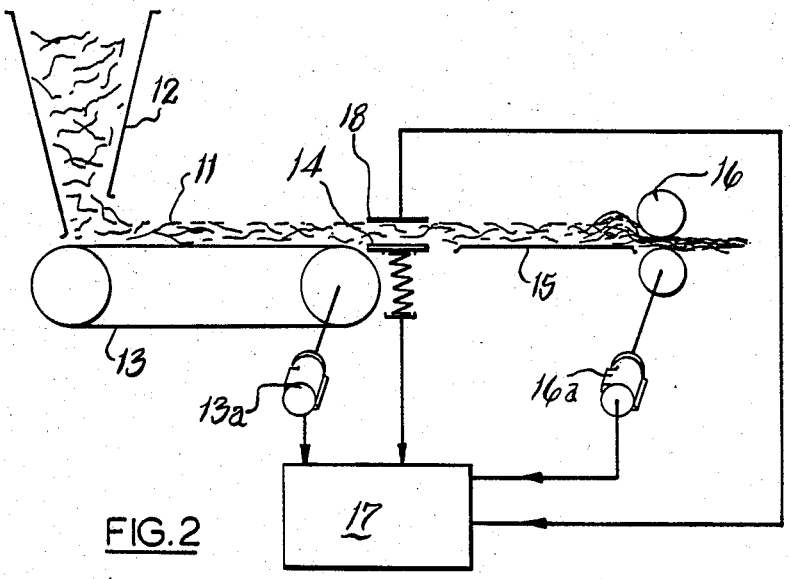
FIG. 2 is a diagrammatic illustration of a second embodiment.
Figure 3:
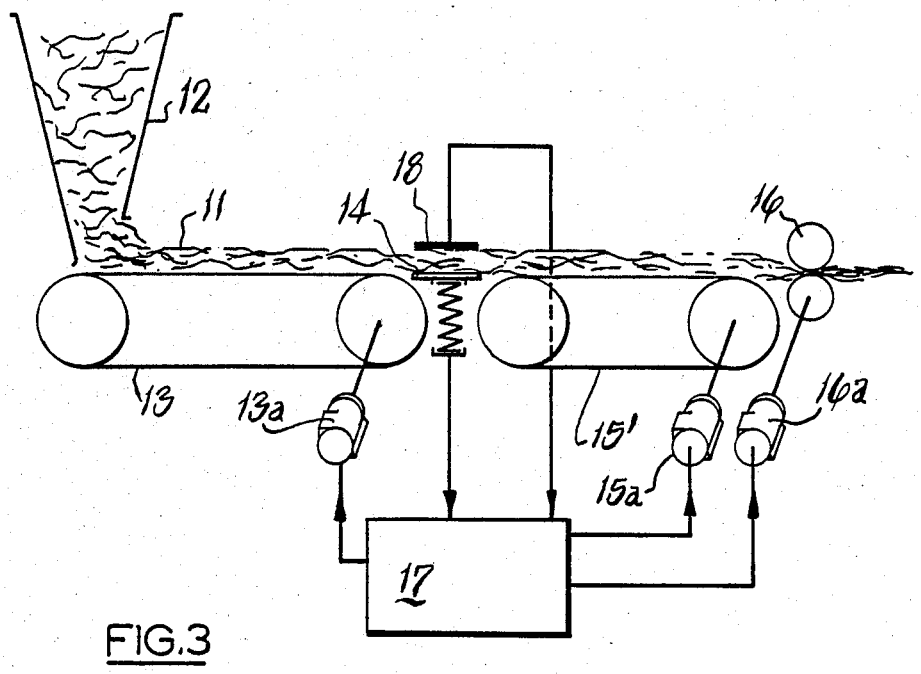
FIG. 3 is a diagrammatic illustration of a third embodiment.

FIGS. 1 to 3 illustrate metering arrangements for fibre 11 fed for example from a hopper 12. The arrangements comprise a supply conveyor 13 carrying the fibre 11 to a weighplate 14 and a nip roller arrangement 16 removing the fibre 11 from the weighplate 14. The nip roller arrangement is in each case sufficiently spaced from the weighplate 14 so as not to cause the fibre 11 to accumulate over the weighplate.

Such accumulation is indicated in the Figures as a thickening or bulging-up of the fleece of fibres 11 just upstream of the nip rollers 16. According to the invention, all that is necessary to prevent such accumulation affecting the operation of the weighplate 14 is to space the nip rollers 16 sufficiently far from the weighplate 14. In practice, depending upon the resiliency of the fibres of the fleece, the minimum spacing is equal to the depth or thickness of the fleece as it passes on to the weighplate 14.

It may be that a spacing is chosen between the weighplate 14 and the nip rollers 16 which is such that some fleeces will tend to sag and require further support between the edge of the weighplate 14 and the nip rollers 16. Such further support can be in the form of a bridging plate 15 as shown in FIG. 2, or a take-off conveyor 15' as shown in FIG. 3 for an even larger spacing.

By maintaining a slight draft of say about 10% by the nip roller arrangement 16 over the supply conveyor 13, any tendency for the fibres to accumulate on the weighpan is further reduced or avoided.

Where a take-off conveyor 15' is provided as illustrated in FIG. 3, it may be driven, say, 10% faster than the supply conveyor 14 and a further slight draft may be provided between the take-off conveyor 15' and the nip rollers 16.

The supply conveyor 13, the take-off conveyor 15', where provided, and the roller arrangement are driven independently so that their speeds do not always have to remain the same or in constant relation to one another. Control means 17 are provided which control the speeds of motors **13*a*, 15*a* and 16*a* severally driving the conveyors 13 and 15' and the roller arrangement 16. The control means 17 operate to effect a constant weight output by controlling the speed of the supply conveyor 13 in response to signals from the weighplate 11 so as to tend to maintain the indicated weight constant, while the speed of the take-off conveyor is held steady. Different rates of metering may be called for by adjusting the speed of the conveyor 15' or nip rollers 16 and/or the weight setting of the weighplate 14**.

The surface of the weighplate 14 and of the bridging plate 15, where provided, is of poly-tetrafluoroethylene which has a low coefficient of friction with the fibres 11 and helps avoid any tendency of the fibres to accumulate on the weighplate or bridging plate. The take-off conveyor 15 where provided desirably has a surface which is rougher or has a higher frictional coefficient with the fibres, and the supply conveyor 13 may also with advantage have such a rougher or higher friction surface.

The weighplate 14 forms one electrode of a capacitance device of which the other electrode 18 is placed above the weighplate 11. Measurement of the capacitance of this device gives an indication of the moisture content of fibre passing between the electrodes and this measurement is input to the control arrangement 17 to affect the rate of metering compensatively. If a higher moisture content is detected, the rate of metering can be increased either by increasing the weight setting of the weighplate 14 or by increasing the speed of the take-off conveyor 15' or nip rollers 16.

The roller arrangement 16 may feed directly into a carding machine for the production of a card web from which a fleece can be prepared for non-wovens manufacture or from which a sliver can be prepared for eventual production of yarn. The improved metering arrangement will give more even quality of fabric or yarn than conventional arrangements.

Figure 4:
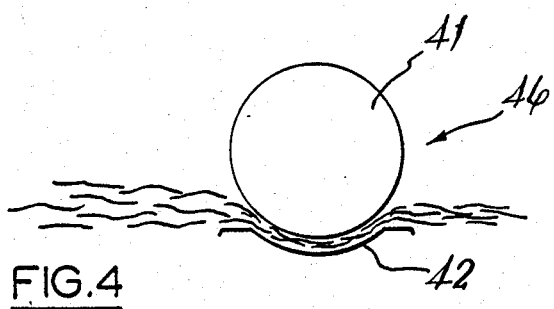
FIG. 4 is a diagrammatic illustration of an alternative roller arrangement.

FIG. 4 shows roller arrangement 46 alternative to the nip roller arrangement 16 of FIGS. 1 to 3 and comprising a roller 41 and a cooperating dish 42. In the embodiment of FIG. 2, the dish 42 can be a continuation of the bridging plate 15.

I claim:

1. A fibre metering arrangement comprising a supply conveyor conveying fibre in a delivery direction to a delivery end thereof, a non-conveying weighplate positioned downstream from said delivery end, whereby said supply conveyor carries fibre to said weighplate, and a roller arrangement downstream from said weighplate for removing fibre from said weighplate, said roller arrangement being spaced from said weighplate by a distance sufficient to prevent fibre from accumulating over said weighplate.

2. A fibre metering arrangement according to claim 1, in which the said roller arrangement comprises nip rollers.

3. A fibre metering arrangement according to claim 1, wherein said distance is at least equal to the thickness of any fibre to be metered by the arrangement.

4. A fibre metering arrangement according to claim 3, in which said roller arrangement comprises nip rollers having a nip point, said nip point being spaced at least ten centimeters distance from an edge of the weighplate.

5. A fibre metering arrangement according to claim 1, in which the said roller arrangement comprises a single roller and a dish cooperating with said single roller.

6. A fibre metering arrangement according to claim 1, comprising further fibre support means provided between the weighplate and the nip rollers.

7. A fibre metering arrangement according to claim 6, said further support means comprising a bridging plate.

8. A fibre metering arrangement according to claim 6, said further support means comprising a take-off conveyor.

9. A fibre metering arrangement according to claim 8, in which a draft is provided between the supply conveyor and the take-off conveyor.

10. A fibre metering arrangement according to claim 9, in which the take-off conveyor runs 10% faster than the supply conveyor.

11. A fibre metering arrangement according to claim 9, in which a draft is provided between the roller arrangement and the take-off conveyor.

12. A fibre metering arrangement according to claim 11, in which the roller arrangement runs 10% faster than the take-off conveyor.

13. A fibre metering arrangement according to claim 10, in which the roller arrangement is driven independently of the supply conveyor.

14. A fibre metering arrangement according to claim 8, in which the take-off conveyor is driven independently of the supply conveyor.

15. A fibre metering arrangement according to claim 1, in which a draft is provided between the supply conveyor and the roller arrangement.

16. A fibre metering arrangement according to claim 15, in which the roller arrangement runs 10% faster than the supply conveyor.

17. A fibre metering arrangement according to claim 1, including control means operative to effect a constant weight output.

18. A fibre metering arrangement according to claim 17, in which said control means include means to control the speed of the supply conveyor in response to signals from the weighplate so as to tend to maintain the indicated weight constant, while the speed of the roller arrangement is maintained steady.

19. A fibre metering arrangement according to claim 17, in which the bridging plate has a low friction surface.

20. A fibre metering arrangement according to claim 19, in which the low friction surface is of polytetrafluoroethylene.

21. A fibre metering arrangement according to claim 1, in which the weighplate has a low friction surface.

22. A fibre metering arrangement according to claim 21, in which the low friction surface is of polytetrafluoroethylene.

23. A fibre metering arrangement according to claim 1, in which a conveyor of the arrangement has a surface friction substantially higher than that of the weighplate surface.

24. A fibre metering arrangement according to claim 23, in which the moisture content means affects rate of metering so as to compensate for the moisture content of the fibre.

25. A fibre metering arrangement according to claim 1, including means for determining the moisture content of fibres being metered.

26. A fibre metering arrangement according to claim 25, said moisture content means comprising capacitance means.

27. A fibre metering arrangement according to claim 26, capacitance means comprising the weighplate as one electrode.

* * * * *